US007180830B1

(12) United States Patent
Cotsen

(10) Patent No.: US 7,180,830 B1
(45) Date of Patent: Feb. 20, 2007

(54) NOVELTY TIMEPIECE

(76) Inventor: Lloyd E Cotsen, 1880 Veteran Ave., #310, Los Angeles, CA (US) 90025

( * ) Notice: Subject to any disclaimer, the term of this patent is extended or adjusted under 35 U.S.C. 154(b) by 10 days.

(21) Appl. No.: 11/332,662

(22) Filed: Jan. 12, 2006

(51) Int. Cl.
*G04B 19/04* (2006.01)
*G04B 19/06* (2006.01)

(52) U.S. Cl. ..... 368/80; 368/223; 368/232

(58) Field of Classification Search ..... 368/76, 368/80, 223, 228, 232, 234
See application file for complete search history.

(56) References Cited

U.S. PATENT DOCUMENTS 1,689,471 A * 10/1928 Andrusis ..... 40/564
5,008,869 A * 4/1991 Dweck ..... 368/228
6,238,084 B1 * 5/2001 Blotky et al. ..... 368/294

* cited by examiner

*Primary Examiner*—Vit W. Miska
(74) *Attorney, Agent, or Firm*—Hankin Patent Law; Marc E. Hankin

(57) ABSTRACT

The present invention is directed to a novelty item and kit comprising timepiece housing, timepiece face, timepiece hand element and images depicting a combination of morphed and non-morphed images.

10 Claims, 3 Drawing Sheets

NOVELTY TIMEPIECE

FIELD OF INVENTION

This invention relates, generally, to the field of horology, and more particularly to a novelty timepiece with an analog time display where the hour positions are depicted by a combination of morphed and non-morphed images.

BACKGROUND

Timepieces have been used for many hundreds of years to tell the time. In addition to simply informing individuals of the time of day, timepieces, also serve as fashion and novelty items. There are currently no known timepieces which display combinations of morphed and non-morphed images.

Definitions: The following terms are used herein to refer to the following:

Morphing—is a special effect in motion pictures and animations that changes (or morphs) one image into another through an apparently seamless transition. Most often it is used to depict one person turning into another person through some magical or technological means or as part of a fantasy or surreal sequence.

Morphed theme—are combinations of morphed and non-morphed images that represent a collection of family members or friends, depict a particular story, or make a particular statement.

In light of the foregoing, there is a need for a timepiece that forms a novelty function by displaying a combination of morphed and non-morphed images selected by the consumer.

SUMMARY OF THE INVENTION

This invention is directed towards a novelty timepiece comprising a timepiece housing, a timepiece face attached to the front of the housing, hand means including an hour hand, a minute hand, and a second hand for cooperating with the face to provide a time indication, a plurality of non-morphed images printed on the face at spaced intervals, and a plurality of morphed images on the face at spaced intervals.

In one embodiment, the timepiece has a number of non-morphed images which could be repeated. In another embodiment, the timepiece has a number of morphed images which could be repeated.

In one embodiment, the timepiece has a number of non-morphed images which could consist of two, four, or six subjects, repeated enough to equal twelve total images.

In one construction, the timepiece has a number of morphed images selected from a group consisting of ten, eight, and six subjects.

In another construction, the timepiece is a clock. Alternatively, the timepiece is a watch.

In yet another construction, the timepiece has a housing, a timepiece face attached to the front of the housing, hand means including an hour hand, a minute hand, and a second hand for cooperating with the face to provide a time indication, a plurality of non-morphed images printed on an insert card, where the images are at spaced intervals, a plurality of morphed images on the insert card, where the morphed images are at spaced intervals, and where the insert card is affixed onto the timepiece face.

In another embodiment, the invention is a novelty timepiece kit comprising timepiece housing, a timepiece face attached to the front of said housing, hand means including an hour hand, a minute hand, and a second hand for cooperating with the face to provide a time indication, and a plurality insert cards, each depicting different morphed themes, which are affixed onto the timepiece face.

Advantages of the invention are that it is amusing, attractive, easily changeable, and customizable.

BRIEF DESCRIPTION OF THE DRAWINGS

FIG. 3 is an illustration of morphed and non-morphed images on a timepiece face.

Further objects, features, and advantages of the invention will become apparent from the following detailed description taken in conjunction with the accompanying figures showing some preferred embodiments of the invention.

DETAILED DESCRIPTION OF THE DRAWINGS

In the following detailed description of various embodiments of the invention, numerous specific details are set forth in order to provide a thorough understanding of various aspects of one or more embodiments of the invention, however, one or more embodiments of the invention may be practiced without these specific details. In other instances, well-known methods, procedures, and/or components have not been described in detail so as not to unnecessarily obscure aspects of embodiments of the invention.

Figure 1:
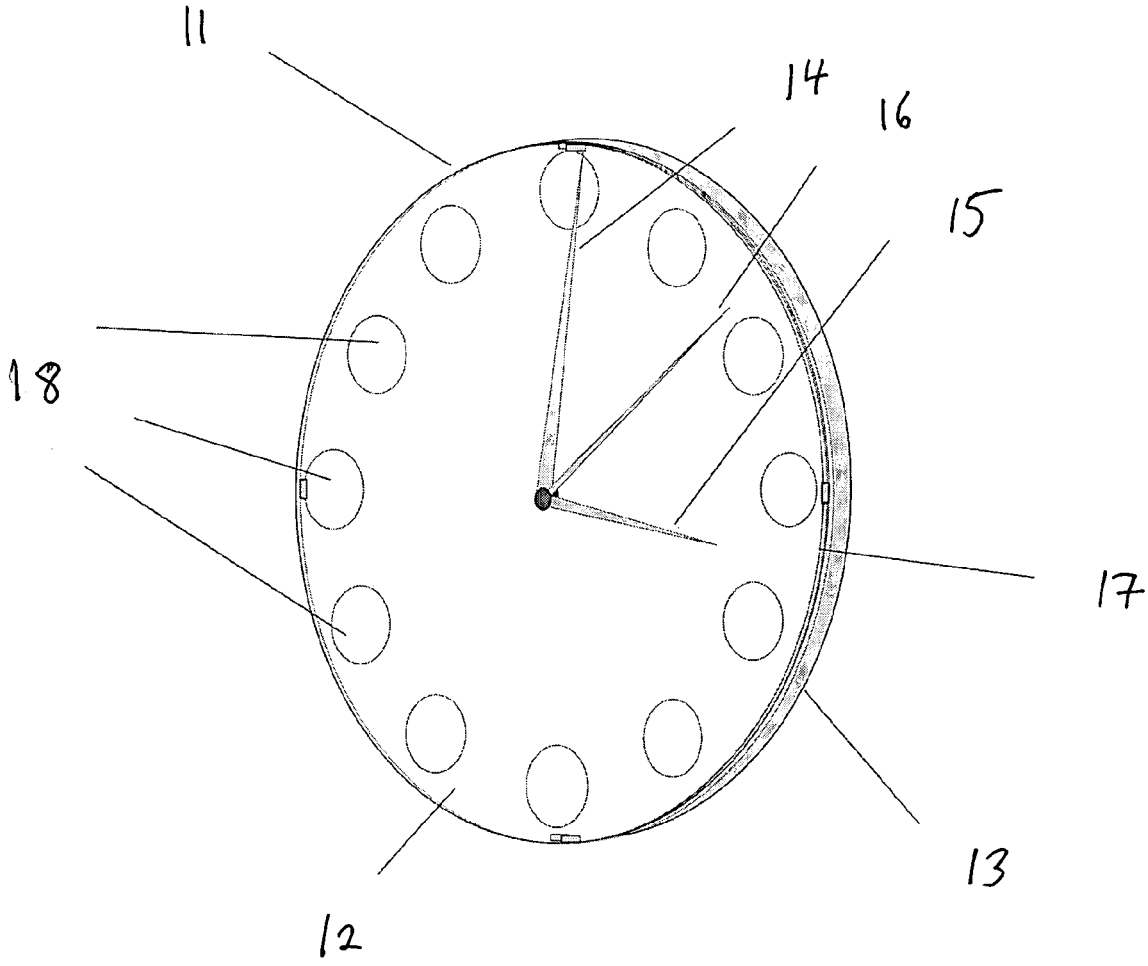
FIG. 1 is a diagrammatic elevation of the novelty timepiece.

With reference now to the FIGURES wherein like reference characters designate like or similar parts throughout the several views, FIG. 1 is a perspective view of the novelty timepiece of the present invention. In the first embodiment, the timepiece is represented as a conventional wall clock. The timepiece includes a housing 11 having front cover 12 and back wall 13. The timepiece also includes a conventional hour hand 15, minute hand 14 and second hand 16. The timepiece hands 14, 15 and 16 (together herein described as timepiece hand element) are driven by a suitable clock drive mechanism, well known to those in the art, for simultaneously driving the hands around the clock face 17. The timepiece also preferably includes a conventional timepiece setting mechanism (not shown) for manual setting of the hour and minute hands 15 and 14. The setting mechanism allows the user to reset the clock movement at any convenient time of the day. The timepiece can be mounted onto a base or onto a wall, and has a power source, which may be internal (battery) or external (plugged into a wall outlet).

Figure 2:
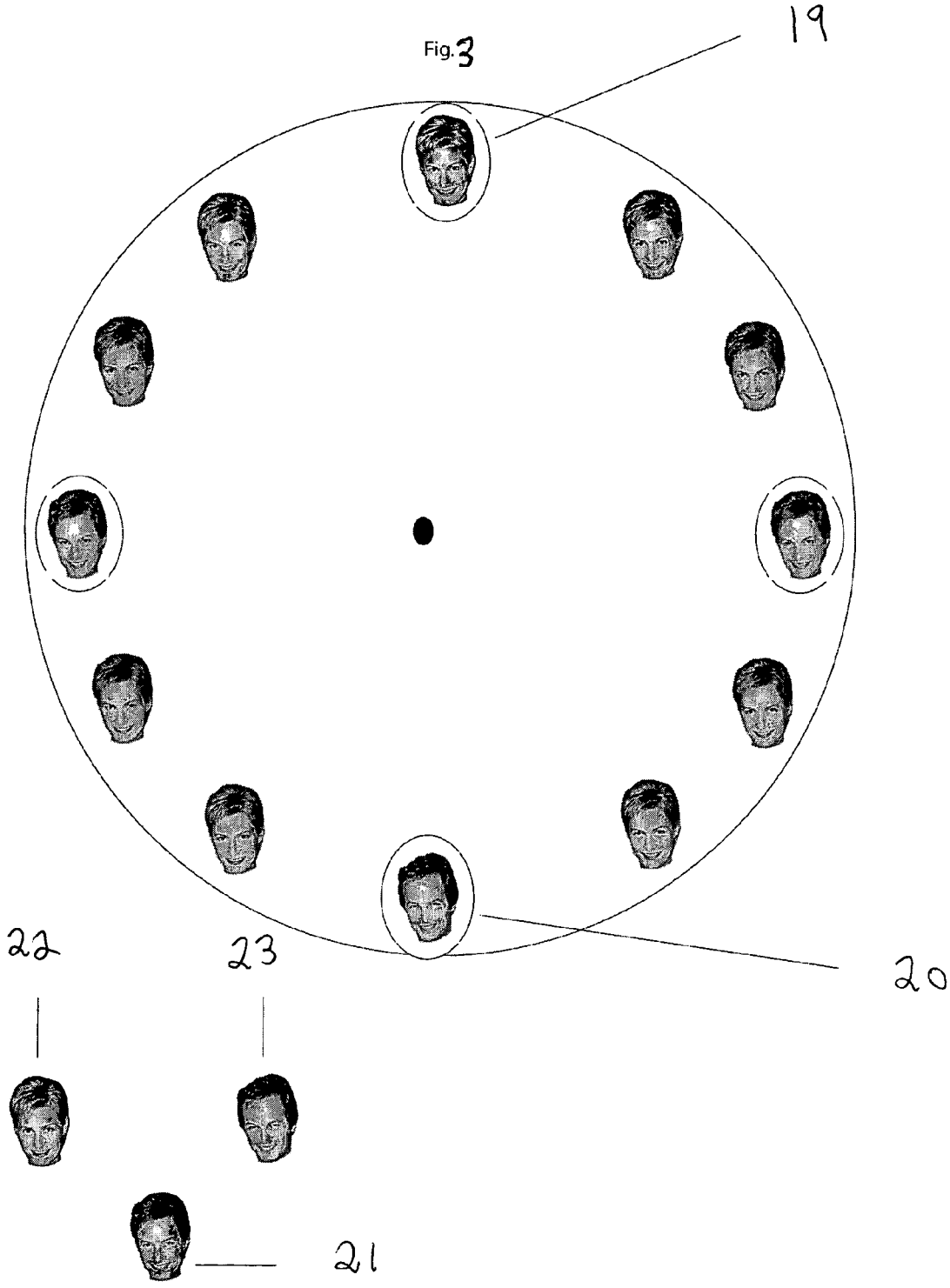
FIG. 2 is an illustration of a morphed imaged derived from two non-morphed original images.

The timepiece includes a timepiece face 17 having a plurality of images 18 printed thereon. These images can be equally or randomly spaced on the timepiece face, and may be generated by hand or computer. Two or more images can be morphed using software programs commercially available. These programs can automatically morph images with relatively little instruction from the user. An illustration of a morphed image 21 derived from two non-morphed images 22 and 23 is shown in FIG. 2.

In one embodiment (see FIG. 3), there are two subject faces opposing each other: subject A at the twelve o'clock position 19 and subject B at the six o'clock position 20. At each of the one, two, three, four and five o'clock positions is a morphed image depicting an ever gradual increase in the blend of subject B's, and less of subject A's features until 100% of subject B's features are arrived at and depicted at the six o'clock position 20. Similarly, at each of the seven, eight, nine, ten and eleven hour positions is a morphed image depicting an ever gradual increase in the blend of subject A's, and less of subject B's features until 100% of subject A's features are arrived and depicted at the twelve o'clock position 19.

It is recognized that instead of two (2) distinct non-morphed subject faces being used to generate ten (10) morph images as described above, it is possible to have four (4) or six (6) distinct non-morphed faces distributed around the clock face generating either eight (8) or six (6) morphed images, respectively. Moreover, it is also possible to have non-morphed subject faces repeated more than once. For example, a non-morphed subject face could be repeated at both the twelve o'clock and six o'clock positions, and another non-morphed face repeated at the three and nine o'clock positions; in between these positions will be morphed images. Examples of morphed themes include, but are not limited to, grandparents at 12 o'clock, morphed into child at 3 o'clock, and which is morphed into grandchild at 6 o'clock. Moreover, morphed subjects are not just limited to humans but include morphing of humans, dogs, cats, and combinations thereof.

Figure 4:
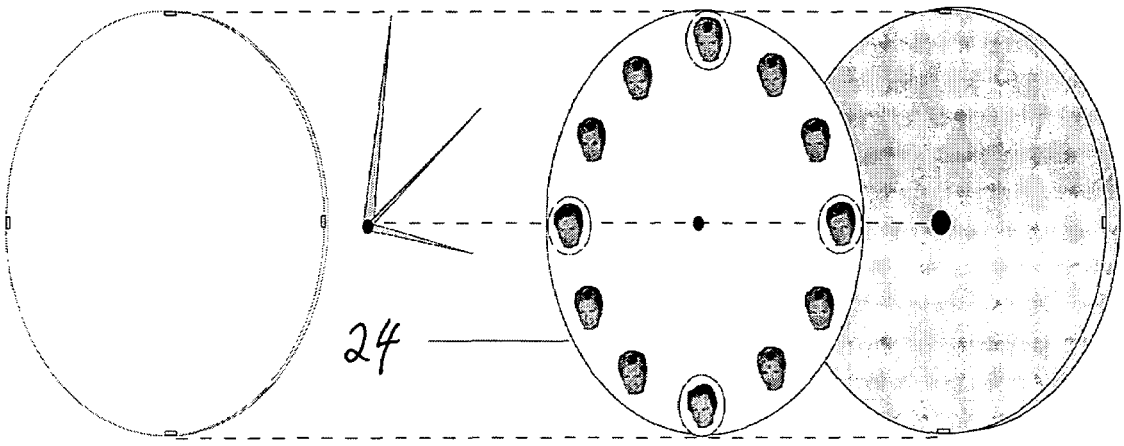
FIG. 4 is a diagrammatic elevation of the novelty timepiece insert card.

It is understood that instead of the images being directly imprinted onto the timepiece face, images could first be printed on an insert card 24 (see FIG. 4) using methods well known to those in the art. The dimensions of the card insert will depend upon the dimensions of the timepiece face chosen by the user but nevertheless will allow the insert to fit snugly onto the clock face 17. The insert card is then attached or affixed using conventional clips or mechanisms known in the art. The card insert can be made of materials such as, but not limited to, paper, plastic, metal, wood, fabric, cloth and combinations thereof.

In addition to a space taken up on the timepiece face 17 or insert 24 for morphed and non-morphed images, there is sufficient space remaining on both for background patterns, decorations, and text (all of which are herein described as "artwork"). Such artwork can be varied according to the morph theme and the purpose for which the novelty timepiece is intended. For instance, the artwork can vary depending upon whether the novelty timepiece is intended as a wedding gift, family gift, seasonal gift, or a gift for pet owners.

In another embodiment, the timepiece is represented as a watch to be worn around the wrist or hung from a cord, or jewelry item. In this embodiment, the non-morphed and morphed images will be proportionally smaller to accommodate the dimensions of the watch face. Alternatively, there may be fewer than twelve (12) images.

Although a circular timepiece is shown here as an example, it is recognized that the timepiece face could also be square, rectangular, or oblong, etc., in shape.

In another embodiment, the invention comprises a kit where a clock timepiece housing, face, and hands are supplied with a variety of insert cards. Each insert card is either selected from a catalogue of traditional morphed themes or else morphed images can be custom generated from the consumer's own non-morphed images. In this embodiment, both the timepiece housing and the timepiece hand element is constructed, in a manner that is well known to those in the art, such that the consumer can easily remove the casing and the hand element 25 in order to interchange the morphed theme inserts as provided in the kit.

It should be understood that the invention has application far beyond the exemplary embodiments presented and described herein, and as such is not to be limited to those embodiments. In addition, the invention is not limited to the particular physical configuration, but instead is adaptable. All changes, modifications, variations, and other uses and applications which do not depart from the spirit and scope of the invention are deemed to be covered by the invention.

The invention claimed is:

1. A timepiece, comprising:

a timepiece housing;

a timepiece face with a center axis attached to the front of said housing; hand means including at least one of an hour hand, a minute hand, and/or a second hand for cooperating with said face to provide a time indication;

a plurality of non-morphed images printed on said face at spaced intervals at angles around the center axis of said face; and a plurality of morphed images printed on said face at spaced intervals, wherein the degree of morphing in said morphed images is related to the angle of placement around the center axis of said face and to the progression of time on said face.

2. The timepiece of claim 1, wherein the number of said non-morphed images can be repeated.

3. The timepiece of claim 2, wherein the number of said morphed images can be repeated.

4. The timepiece of claim 1, wherein the number of said non-morphed images are selected from a group consisting of two, four, and six subjects.

5. The timepiece of claim 2, wherein the number of said morphed images are selected from a group consisting of ten, eight, and six subjects.

6. The timepiece of claim 3, wherein the timepiece is a clock.

7. The timepiece of claim 3, wherein the timepiece is a watch.

8. The timepiece of claim 3, wherein the timepiece is a jewelry item.

9. A timepiece, comprising:

a timepiece housing;

a timepiece face attached to the front of said housing;

hand means including at least one of an hour hand, a minute hand, and/or a second hand for cooperating with said face to provide a time indication;

a plurality of non-morphed images printed on an insert card with a center axis, said images being at spaced intervals;

a plurality of morphed images printed on said insert card, said morphed images being at spaced intervals, wherein the degree of morphing in said morphed images is related to the angle of placement around the center axis of said insert card and wherein said insert card is affixed onto said face and to the progression of time on said face.

10. A novelty timepiece kit comprising:

a timepiece housing;

a timepiece face with a center axis attached to the front of said housing;

a timepiece hand element, comprising at least one of an hour hand, a minute hand, and/or a second hand for cooperating with said face to provide a time indication; and a plurality of insert cards, each depicting different morphed themes, which are interchangeably affixed onto said face, said morphed themes comprising a plurality of morphed images, wherein the degree of morphing in said morphed images is related to the angle of placement around the center axis of said face.

* * * * *